US005429112A

United States Patent [19]

Rozzi

[11] Patent Number: 5,429,112

[45] Date of Patent: Jul. 4, 1995

[54] INFRA-RED RADIANT TUBE HEATER

[76] Inventor: Mario Rozzi, 28972 Hughes, St. Clair Shores, Mich. 48081

[21] Appl. No.: 52,502

[22] Filed: Apr. 26, 1993

[51] Int. Cl.[6] ..... F24H 3/00

[52] U.S. Cl. ..... 126/116 A; 126/104 A; 126/110 D; 126/114; 126/92 G; 126/91 A

[58] Field of Search ..... 126/116 A, 114, 104 A, 126/110 D, 91 A, 92 B, 85 A, 85 B, 92 C; 431/6, 356

[56] References Cited

U.S. PATENT DOCUMENTS

| | | | |
|---|---|---|---|
| 2,226,816 | 12/1940 | Hepburn | 126/91 A |
| 2,386,115 | 10/1945 | Holthouse | 126/114 X |
| 3,140,706 | 7/1964 | Block et al. | 126/114 X |
| 3,828,762 | 8/1974 | Duzey | 126/91 A |
| 3,980,069 | 9/1976 | Butlak et al. | 126/91 A |
| 4,053,279 | 10/1977 | Eichenlaub | 126/92 C X |
| 4,869,230 | 9/1989 | Fletcher et al. | 126/91 A |
| 5,253,635 | 10/1993 | Overall et al. | 126/85 B |

OTHER PUBLICATIONS

RV Series Vented Radiant Tube Heater Operation, Installation Manual (Feb. 1991).

RTP Series Unvented or Vented Radiant Tube Heater Operation, Installation Manual Sun Technology Corp., Shelby Twp., Mich. (no date).

Design & Engineering Guide–Latest Technology Vacuum Tube Heaters, Ray-Tec, Sun Technology Corp., Shelby Twp., Mich. (Aug. 1990).

*Primary Examiner*—Larry Jones

*Attorney, Agent, or Firm*—Brooks & Kushman

[57] ABSTRACT

A gas radiant tube heater and method of operating the heater. The heater has a housing and a radiant tube mounted within the housing. The heater further has a modular control box mounted within the housing in which serviceable parts can be easily removed as a unit and replaced. The housing and control box are sealed against the elements for outdoor as well as indoor use. The control box is divided into two chambers, with the inlet air flowing from a first chamber into a second chamber. The first chamber is subjected to a vacuum pressure, in which the heat sensitive equipment is mounted, and the second chamber is subjected to a positive pressure, in which the combustible gas and air mix prior to combustion. The heater further has a pressure switch to shut off the gas supply if the air flow through the heater is blocked, and a flame sensor to shut off the gas supply if the ignition element fails to ignite the air/gas mixture.

17 Claims, 3 Drawing Sheets

INFRA-RED RADIANT TUBE HEATER

TECHNICAL FIELD

This invention relates to gas heaters and methods of operating the same, and more particularly to gas radiant tube heaters.

BACKGROUND ART

Gas infra-red radiant tube heaters are well known in the art. The basic concept involves a gas heater which uses a forced mixture of a combustible gas, such as natural gas, and air flowing within a radiant tube over an ignition element to ignite and burn the mixture. This burning causes the tube to heat up and radiate the heat therefrom. Typically within the heater assembly are various switches, valves and other components which operate the system in both the normal operating mode and in safety shutdown modes. These components are heat sensitive and cannot withstand the heat of the combustion. Therefore, should the flame created by the element burn back into the location of the components, they can be severely damaged. Consequently, the need to prevent this damage to the components due to burn-back is a great concern.

For radiant tube heaters in general, four different operating conditions or environments exist. First, the heater may be designed to operate within the residential indoor environment, in which case the exhaust from the heater needs to be vented directly into a flue leading to the outside of the building. Typically, this unit also needs a compact, self-contained unit that can safely mount close to walls or ceilings since space is generally limited. Second, the heater may be designed to operate within the industrial environment. In this case, the exhaust from the heater needs to be operated within a certain type of vented building or vented directly into a flue leading to the outside of the building. Third, it may be designed to operate within the outdoor environment. In this case, it needs to be sealed against moisture, such as rain, to avoid interference with and damage to the heater's interior components. It also needs to be made of a material that resists corrosion. Finally, the heater may be designed to operate within a living area for livestock production, such as raising chickens or pigs in which case, again, the need to be able to vent to the outside of a building. Many of the typical radiant tube heaters cannot be used under all four of these conditions, thus requiring different designs and configurations of heaters for each of these applications.

Furthermore, many of the typical radiant tube heaters are not enclosed within one complete, compact unit which can be quickly and easily installed to operate safely in any one of the four operating conditions. This need can be met by a compact enclosed sealed unit that can safely and easily mount close to building walls or ceilings, can hang at several different angles from horizontal to radiate the heat where it is needed, and can quickly and easily connect to a flue for venting the exhaust directly to the outside of the building.

Additionally, in order to service many typical radiant tube heaters, individual components need to be analyzed for damage or defect and repaired on location. This is not as convenient as quickly and simply replacing a single modular unit within the heater that contains all of the serviceable parts and can be sent back to the manufacturer for factory service at a later time.

DISCLOSURE OF INVENTION

The present invention includes a gas radiant tube heater assembly for mixing and burning pressurized combustible gas and air. The heater includes a housing and a modular control box removably coupled to the housing. The heater has a first sealed chamber formed by the control box and housing provided with a limited opening adapted to receive the air from the surrounding ambient air. The heater further has a second sealed chamber formed by the control box and housing provided with a first opening to the first chamber, a receiving means for receiving the pressurized gas, and a second opening spaced from the first opening. A radiant tube, having first and second ends, is mounted within the housing. The first end is connected to the second opening of the second sealed chamber whereby the air and gas will flow into the radiant tube from the second sealed chamber. The second end of the radiant tube is open to the ambient air surrounding the heater assembly. The heater also includes a blower mounted within the first sealed chamber coupling the first and second sealed chambers through the second opening. The blower transfers the air from the first chamber into the second chamber, and from the second sealed chamber into the radiant tube, whereby the blower creates a vacuum pressure in the first sealed chamber and a positive pressure in the second sealed chamber. Further, the heater has an ignition means, within the radiant tube, for igniting the air and gas flowing into the radiant tube.

The present invention also contemplates a method of operating a gas radiant tube heater. The heater is provided with a housing and a control box, removably coupled to the housing. The housing and control box form a first sealed chamber and a second sealed chamber coupled to the first. The second sealed chamber, in turn, is coupled to a radiant tube. A step comprises providing a limited air opening into the first sealed chamber from ambient surrounding air. Another step comprises creating a vacuum pressure in the first sealed chamber and a positive pressure in the second sealed chamber whereby air flows from the first sealed chamber into the second sealed chamber. A further step is comprised of providing an interruptable source of pressurized combustible gas into the second sealed chamber. Another step comprises mixing air in the second sealed chamber with the pressurized gas in the second sealed chamber. Another step comprises providing an air outlet from the second sealed chamber into the radiant tube. And one of the steps comprises burning the air/gas mixture within the radiant tube.

Accordingly, it is an object of this invention to provide a radiant tube heater in which heat sensitive components are located in a vacuum chamber, that is under a vacuum pressure, adjacent to a pressurized gas/air mixing chamber, that is under a positive pressure, to thereby avoid burn-back of a flame into the vacuum chamber and protect the heat sensitive equipment.

A feature of this invention is that the radiant tube heater is provided with a modular design wherein all serviceable parts are packaged in a modular unit, or control box, that allows the unit to be replaced quickly and easily whereby the heater can be returned to operation as soon as possible.

An advantage of this invention is to provide a compact radiant tube heater that has an input of 20,000 to 50,000 BTU per hour and yet still may have its top side within six inches of a mounting surface, providing greater flexibility in mounting the heater within the area to be heated.

A further advantage of this invention is to provide a radiant tube heater that is capable of safely operating in all four of the above-identified environments.

The foregoing and other objects, features and advantages of the present invention are readily apparent from the following detailed description of the best modes for carrying out the invention when taken in connection with the accompanying drawings.

BEST MODES FOR CARRYING OUT THE INVENTION

Figure 1:
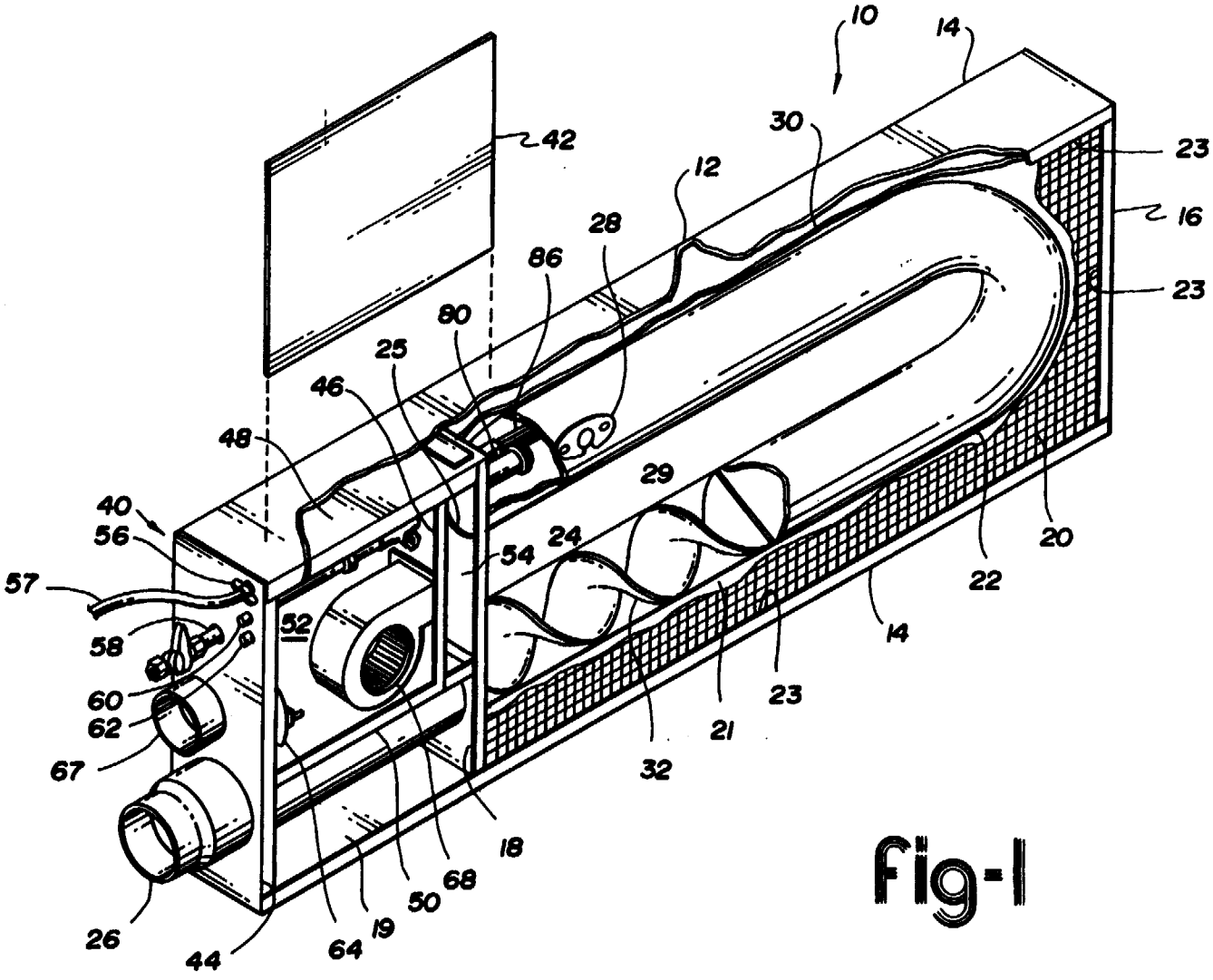
FIG. 1 is a perspective partially exploded schematic view of the heater assembly in accordance with the present invention, with the electrical wiring not shown.
Figures 2, 5:
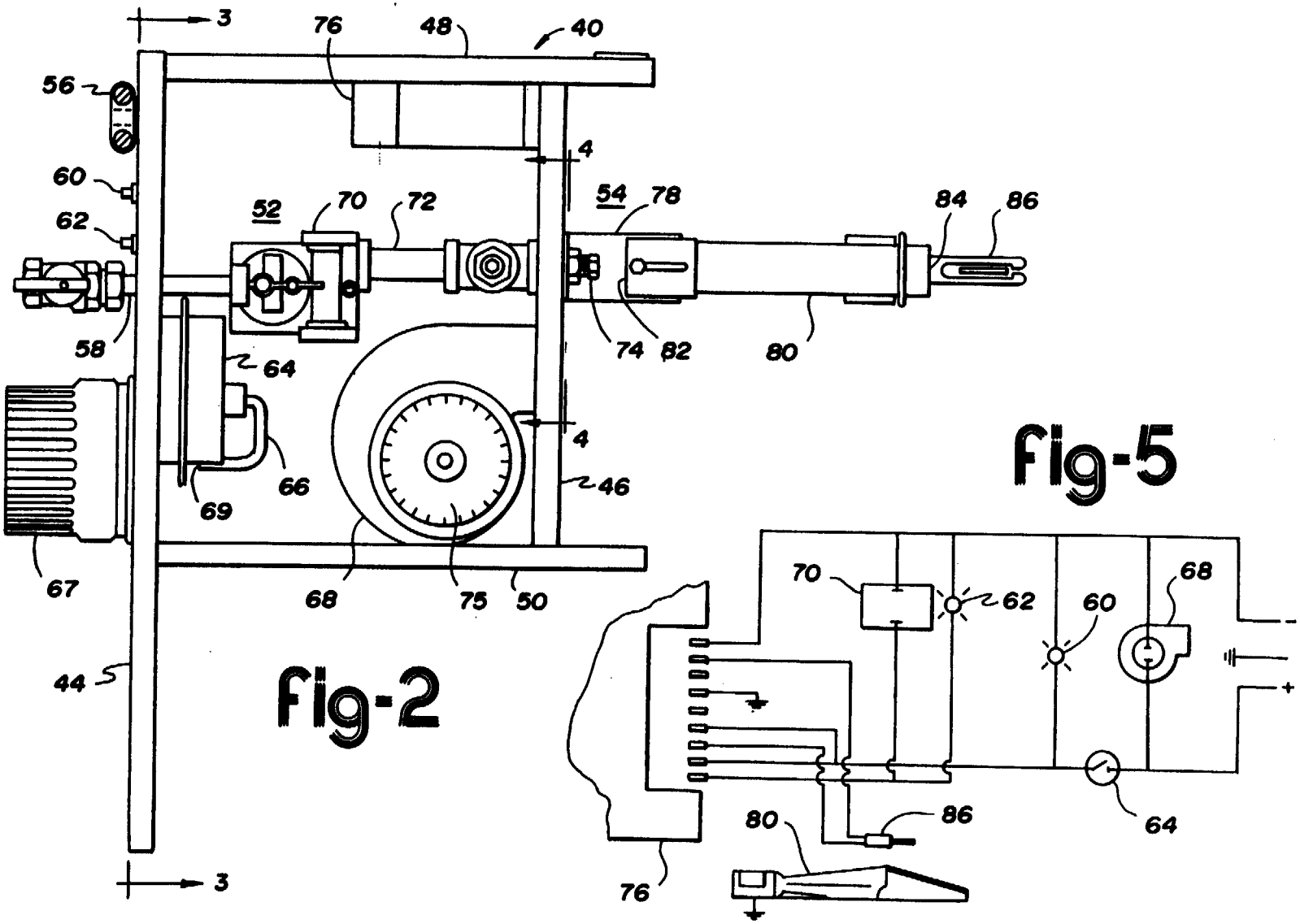
FIG. 2 is a plan view on an enlarged scale of the heater control box and components in accordance with the present invention, with the electrical wiring not shown.
FIG. 5 is a schematic wiring diagram for the components within the heater assembly in accordance with the present invention.

FIG. 1 illustrates the overall heater assembly, which is completely enclosed by the box shaped main housing 10. This housing 10 is preferably made of an aluminized steel, a steel that is coated on both sides with an aluminum or silicon-aluminum alloy, to have adequate heat and corrosion characteristics. This material allows the housing 10 to be capable of operating in each of the four operating environments. The top side 12 and two opposite long sides 14, running the length of the housing 10, are formed from one sheet of material. A short end 16 is affixed to one end of the top 12 and long sides 14. This configuration seals the top 12, long sides 14 and end 16 of the unit. This configuration, along with a modular unit discussed below, which seals the other end, allows the heater to be sealed for outdoor use.

Parallel to the short end 16 and located intermediate within the housing 10 is internal end wall 18. It is affixed along its edges to the top 12 and long sides 14. This internal end wall 18 divides the housing 10 into two general areas 19 and 21. The bottom side can be left open, although preferably, a metal grill 20 is used to cover area 21. The grill 20 is mounted to the housing 10 by engaging it with lips 23 protruding from the edges of the long sides 14, short end 16 and internal end wall 18. The grill 20 helps direct the heat as it radiates from the housing 10.

Mounted within the main housing 10 is a radiant tube 22. The interior of this tube 22 is effectively the combustion chamber for this heater. The tube 22 is preferably made from an aluminum coated steel having good high temperature and corrosion characteristics such as that sold under the trademark "ALUMI-THERM," made by Armco Inc., of Middletown, Ohio. Alternatively, the tube 22 may be made of a stainless steel material instead of the aluminum coated steel. The tube 22 mounts within the housing 10 spaced from the surface of the housing 10. A first open end 24 of the tube 22 connects to the internal end wall 18, which has a hole 25 through it at this point to receive the tube 22. A second open end 26 of the tube 22 protrudes from the housing 10 and is for discharging the exhaust produced by the combustion of the gas and air mixture within the tube 22. This second end 26 may be connected to an exhaust flue (not shown) which vents the exhaust directly outside of a building. The flue will allow this unit to be safely used in various indoor environments.

Although not required, preferably a twisted metal baffles 32 is located within the tube 22, which helps to better distribute the heat within the tube 22 as the hot exhaust flows through it. Additionally, the outer surface of the tube 22 may be painted with high temperature black paint. Mounted to the outside of the tube 22, at a cutout 29 in the tube 22, near its first end 24 is a sight glass 28. This sight glass 28 is located at the initial point of combustion within the tube 22 and allows an operator to inspect this area within the tube 22 to determine if proper combustion is occurring.

Mounted between the tube 22 and the housing 10 is a reflector 30. It is attached along the top 12 and long sides 14 between the short end wall 16 and the internal end wall 18. The reflector 30 is preferably made of an aluminum sheet that is buffed on its surface facing the tube 22, creating a highly reflective surface. The reflector 30, although attached along its sides to the housing 10, is spaced from both the housing 10 and the tube 22 along its surface. This spacing allows it to reflect heat outward towards the bottom of the housing 10 while partially insulating the top side 12 of the housing 10 from the heat. By reflecting the heat towards the bottom and away from the top 12 and long sides 14, the reflector allows these outer surfaces of the unit to remain cool enough to safely mount it relatively close to walls or ceilings.

The modular unit or control box 40 is illustrated in FIGS. 1 to 4. The control box 40 is formed of four sheet metal members. The first is an end member 44 that fits between and abuts the ends of two long sides 14 of the housing 10. Opposite is a second parallel intermediate end member 46 of a shorter length. It is connected by two side members 48, 50 such that the two side members 48, 50 extend beyond where they attach to the intermediate end member 46. When the control box 40 is inserted into the main housing 10, the end member 44 extends completely between the sides 14 of the housing 10 from the top side 12 to the bottom; the first side member 48 fits adjacent to one of the long sides 14; while the other side member 50 is intermediate of the long sides 14. The two side members 48, 50 abut the internal end 18 of the main housing 10.

This configuration creates two separate chambers. A vacuum chamber 52 is formed between the end member 44 and the intermediate end member 46, and a pressure chamber 54 is formed between the intermediate end member 46 and the internal end 18; with each chamber enclosed between the two side members 48, 50. The cover 42 attaches to the bottom side along the side member 48, internal end 18, intermediate side member 50 and end member 44. The cover 42, then, will completely enclose and seal the two chambers 52, 54 on their bottom side. Foam rubber sealing strips (not shown) can be used around the edges where the cover 42 is attached to ensure proper sealing of the two chambers 52, 54. This overall configuration, therefore, also protects the components of the heater from exposure to outside elements, which allows it to be used safely in the outdoor environment.

Mounted to the end member 44 is an electrical receptacle 56 through which a conventional electrical power cord 57 passes. The gas supply line 58 passes through a hole 59 in the end member 44 that is connected to a source of pressurized gas. A power on indicator light 60 and a gas valve open indicator light 62 also protrude from the end member 44 through holes 61 and 63 respectively to allow an operator to observe the lights during operation of the heater. The end member 44 includes an air inlet opening 65 through which air can flow in from the ambient air surrounding the heater. Optionally, the ambient air can be drawn in from outside of a building through an air intake duct (not shown) that connects to an air inlet duct connector 67, which may be attached to the end member 44 encircling the inlet opening 65.

Mounted within the vacuum chamber 52 on the end member 44 near the air inlet opening 65 is a differential pressure switch 64. The purpose of this switch is to sense if there is air flowing into the vacuum chamber 52, thus acting like a velocity sensor. Protruding from the pressure switch 64 is a first end of a hollow pressure tube 66. The pressure tube 66 is oriented such that a second end 69 faces towards the end member 44, centered within and generally normal to the air inlet opening 65, in order for the second end 69 to face directly into the opening 65.

The switch is normally open when the pressure is the same on both sides of a membrane (not shown) within the switch. The switch is coupled to an electric circuit discussed below. The pressure switch 64 activates when it senses a difference in pressure on either side of the membrane. This pressure difference is the difference in pressure between the static air pressure within the vacuum chamber 52 and the pressure as measured by the second end 69 of hollow pressure tube 66. When air is flowing through the opening 65, this air flows past the second end 69 of the tube and causes a head pressure. Since the head pressure will be greater than the static air pressure, the pressure difference will close the pressure switch.

Affixed to the side member 48 within the vacuum chamber 52 is an electronic control module 76. Also mounted within the vacuum chamber 52, to the intermediate end member 46, is a blower 68. The blower 68 includes an air inlet 75 within the vacuum chamber 52 and an air outlet that encircles and is sealed around an opening 71 through the intermediate end member 46 into the pressure chamber 54. When the blower 68 is activated, the suction from the blower drawing air into its air inlet 75, in the vacuum chamber 52, and pushing it out into the pressure chamber 54 creates a pressure differential between the two chambers 52, 54. The pressure chamber 54 will be at a higher pressure than the vacuum chamber 52.

The gas supply line 58 couples to a gas valve 70 within the vacuum chamber 52. The gas valve 70, in turn, couples to a second gas line 72 that protrudes through a bore 73 in the intermediate end member 46 into the pressure chamber 54. The second gas line 72 couples to a gas orifice 74 within the pressure chamber 54.

Located within the pressure chamber 54 is a support member 78, mounted to the intermediate end member 46, that supports a burner 80. The burner 80 is a tube, with its first open end 82 spaced from and aligned with the gas orifice 74 and its second open end 84 protruding through internal end 18 into the first open end 24 of the radiant tube 22. Mounted to the outside of the burner 80, near the second open end 84, is an electric ignition element referred to as a glo-bar 86. The glo-bar 86 is electrically insulated from the burner 80. The glo-bar 86 extends in front of the second open end 84 of the burner 80. Most of the length of the burner 80 and all of the glo-bar 86 are enclosed within the radiant tube 22. The glo-bar 86 aligns with and can be viewed within the tube 22 by an operator through the sight glass 28. The sight glass 28 allows an operator to view the flame within the tube 22 while the heater it is operating.

Because the overall unit is enclosed within this main housing 10, the heater can be easily mounted as a unit from a ceiling and/or a wall. Moreover, the overall unit can be mounted at various angles from the horizontal to better direct the heat radiated from it in different directions. With this design, a unit having an output of approximately 20,000 to 50,000 BTU/hour can be mounted with its top side 12 within six inches from the ceiling or wall. The air intake may easily connect, via an inlet duct, to an outside source of ambient air as well as being left open to the ambient air immediately surrounding the unit. Further, the exhaust outlet may easily connect to a flue for directing the exhaust directly outside of the building. This unit, then, can safely operate in all four of the above-mentioned environments.

Figure 3:
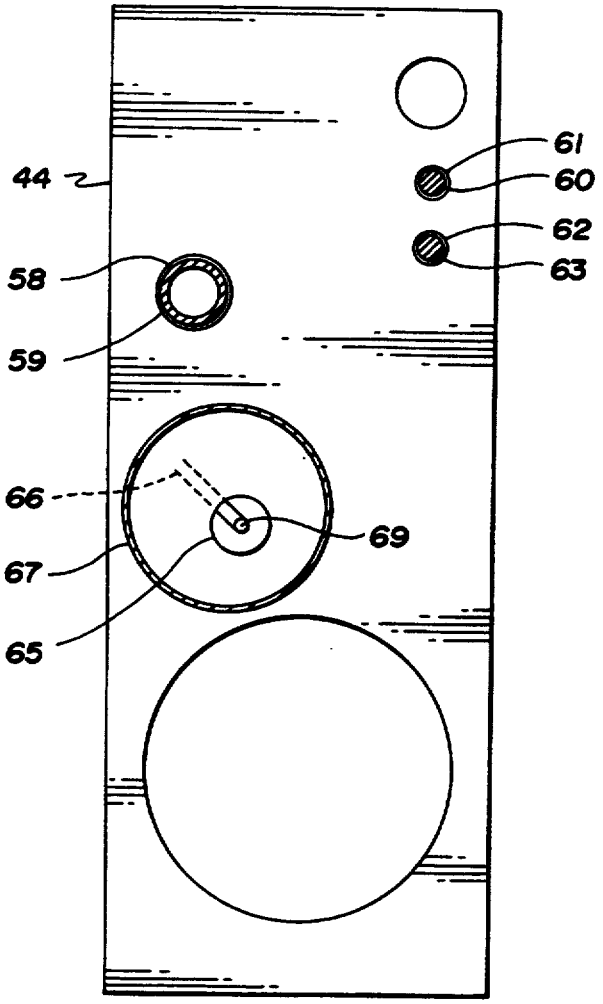
FIG. 3 is a sectional view taken along line 3—3 in FIG. 2.
Figure 4:
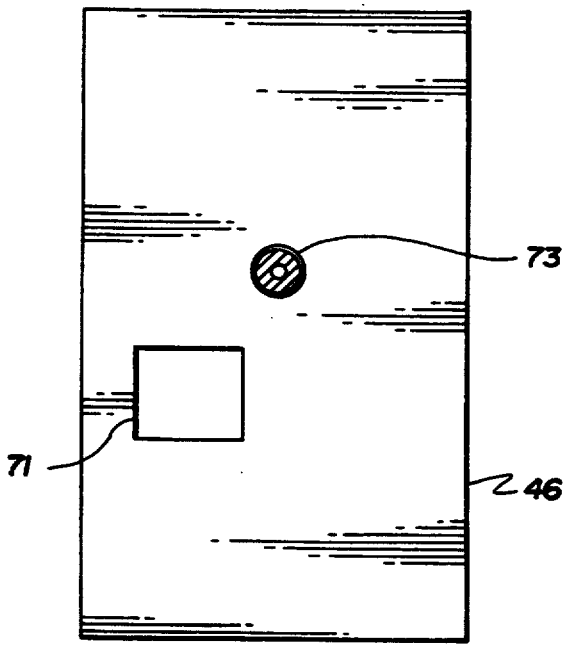
FIG. 4 is a sectional view taken along line 4—4 in FIG. 2.

The electrical circuit wiring of the components within this heater assembly is illustrated by the schematic diagram in FIG. 3. Like elements are numbered with like reference numerals to illustrate structural identity with reference to FIGS. 1–4. The functioning of this electric circuit will become apparent as the method of operation of the heater is disclosed below.

In operation, as power is supplied to the heater unit, the blower 68 begins to operate. This forces air through the unit by drawing it in through the air inlet opening 65 in the end member 44 and blowing it through the opening 71 in the intermediate end member 46. This, in turn, pushes the air through the tube 22. At the same time, the control module 76 sends a large electric current through the glo-bar 86 to heat it up. When the control module 76 senses that the glo-bar 86 has reached a predetermined temperature, preferably around 2300° F., it sends a signal to open the gas valve 70. The control module 76 also stops the large electric current flowing through the ignition element 86. The temperature of the glo-bar 86 is determined by the control module 76. It senses the electrical current flowing through the glo-bar 86 which is in proportion to the temperature of the glo-bar element 86. This is due to the fact that the glo-bar's electrical resistance decreases as it increases in temperature.

The action of the blower 68, by drawing air from the vacuum chamber 52 into the pressure chamber 54, creates a pressure in the vacuum chamber 52 that is generally below atmospheric pressure, and a pressure in the pressure chamber 54 that generally is above atmospheric pressure. The air flow through the vacuum chamber 52, caused by the blower 68, also helps to keep the components in the vacuum chamber 52 cool. Otherwise, the components would heat up due to induction of heat through the housing 10 and into the components.

The pressurized combustible gas flows through the gas valve 70 and out of the gas orifice 74 into the pressurized chamber 54. Here, it mixes with the air flowing through the pressurized chamber 54 and passes over the heated glo-bar 86. The glo-bar 86 ignites this gas/air mixture and the resulting combustion heats the radiant tube 22 as the exhaust flows through the tube 22. The baffles 32 within the tube 22 help to distribute the heat within the exhaust to better heat the tube 22, resulting in more heat radiating from the tube 22. The heat radiating from the tube 22 is directed away from the top 12 and sides 14 of the heater by the reflector 30 and directed outward by the grill 20 to heat the space beneath the heater.

Gas shut-off safety features are also incorporated into the operation of the heater. The first safety feature ensures that air is flowing through the system. The pressure switch 64 is normally in its open position, which results in an open electric circuit. This open circuit prevents the control module 76 from sending a signal to open the gas valve 70. When, on the other hand, air is flowing through the air inlet opening 65, due to the blower 68 drawing in air, the second end 69 of the pressure tube 66 senses a positive head pressure from the air flowing past it. That is, the pressure sensed by the tube 66 on the pressure switch 64 is greater than the static pressure within the vacuum chamber 52. This pressure difference closes the pressure switch 64. The electrical circuit is now closed and the control module 76 can open the gas valve 70. The pressure switch safety feature is used to shut off of the flow of gas if the air stops flowing through the unit due to blockage of the air inlet or exhaust opening, or a blower motor failure.

This safety feature also assures that the vacuum chamber 52 will remain at a lower pressure than the pressure chamber 54 while ignition is occurring. The pressure difference prevents the possibility of burn-back into the vacuum chamber 52, thus preventing possible damage to the temperature sensitive equipment. The combination of the pressure difference along with the extra barrier of the intermediate end member 46, therefore, ensures the protection of the components in the vacuum chamber 52 from heat should the flame, which normally initiates at the glo-bar 86, burn back out of the tube 22.

The heater also has another safety feature which ensures that the gas valve 70 is closed if the glo-bar 86 is not igniting the gas/air mixture. During normal operation, a very small electrical current continuously passes through the glo-bar 86 and the flame to the burner 80, which is grounded. The flame acts like an electrical wire connecting the glo-bar 86 and burner 80. The control module 76 monitors this current flow. If the flame goes out, this electrical connection between the glo-bar 86 and burner 80 is broken. The control module 76 senses the broken circuit and closes the gas valve 70. The control module then sends a large electrical current through the glo-bar 86 to once again heat it up as in the initial ignition process. A further feature of this invention is its modular design. All of the serviceable components affix to the control box 40. Should one of the components in the control box 40 fail to operate properly, then a service technician can easily and quickly return the heater unit to operation by simply replacing the entire control box 40, with all of its internal components, all at once. The technician only needs to disconnect the power cord and the gas line. The failed component can later be diagnosed and repaired off sight without the need to replace the entire heating unit or make the user do without the heater for a time.

In an alternative design, the sealed vacuum chamber/pressure chamber configuration can also be used within a control box design in a radiant tube heater that is much larger and has a tube that is not contained within a single housing assembly. This again would protect heat sensitive equipment from potential damage due to burn-back.

While the best mode for carrying out the invention has been described in detail, those familiar with the art to which this invention relates will recognize various alternative designs and embodiments for practicing the invention as defined by the following claims.

I claim:

1. A control unit assembly adapted for use with a gas radiant tube heater which burns a mixture of combustible gas and air having a housing and a radiant tube mounted within the housing, the control unit assembly comprising:

a modular control box adapted to be removably attachable to the housing;

a first sealed chamber formed by the control box, the first sealed chamber provided with a limited opening adapted to receive the air from surrounding ambient air;

a second sealed chamber formed by the control box and housing, the second sealed chamber provided with a first opening communicating to the first chamber, receiving means for receiving the combustible gas, and a second opening adapted to cooperate with the radiant tube and spaced from the first chamber opening; and a blower mounted to the modular control box within the first sealed chamber coupling the first and second sealed chambers through the second opening which transfers the air from the surrounding ambient air into the first sealed chamber, then from the first sealed chamber into the second sealed chamber, and from the second sealed chamber into the radiant tube, whereby the blower creates a pressure in the first sealed chamber which is less than a pressure in the second sealed chamber.

2. The invention of claim 1 wherein the blower has an air intake within the first sealed chamber and an air output sealingly affixed to the first opening in the second sealed chamber.

3. The invention of claim 1 further comprising a gas valve for stopping the flow of gas, an air velocity sensor and a control module coupled to the air velocity sensor mounted within the first sealed chamber, the control module further coupled to the receiving means, whereby the control module will close the gas valve upon the air velocity sensor sensing a loss of air flow into the first sealed chamber.

4. The invention of claim 3 further including a burner coupled to the modular control box and protruding from the second opening of the second sealed chamber and an ignition element mounted to the burner which is coupled to the control module whereby the control module causes the ignition element to increase in temperature up to a predetermined value.

5. A gas fired radiant tube heater assembly for mixing and burning pressurized combustible gas and air, the heater assembly comprising:

a housing;

a modular control box removably coupled to the housing;

a first sealed chamber formed by the control box and housing, the first sealed chamber provided with a limited opening adapted to receive the air from the surrounding ambient air;

a second sealed chamber formed by the control box and housing, the second sealed chamber provided with a first opening communicating to the first chamber, receiving means for receiving the pressurized gas, and a second opening spaced from the first opening;

a radiant tube mounted within the housing having a first end and a second end spaced from the first end, the first end connected to the second opening of the second sealed chamber whereby the air and combustible gas will flow into the radiant tube from the second sealed chamber, the second end of the radiant tube being open to the ambient air surrounding the heater assembly;

a blower mounted to the modular control box, the blower coupled between the first and second sealed chambers through the first opening which transfers the air from the surrounding ambient air into the first sealed chamber, then from the first sealed chamber into the second sealed chamber, and from the second sealed chamber into the radiant tube whereby the blower creates a vacuum pressure in the first sealed chamber and a positive pressure in the second sealed chamber wherein the modular control box and the blower attached thereto are removable from the housing; and ignition means, within the radiant tube, for burning the air and combustible gas flowing into the radiant tube.

6. The heater assembly of claim 5 further comprising a gas valve for stopping the flow of gas, an air velocity sensor and a control module coupled to the air velocity sensor mounted to the control box within the first sealed chamber, the control module further coupled to the receiving means whereby the control module will close the gas valve upon the air velocity sensor sensing a loss of air flow into the first sealed chamber.

7. The heater assembly of claim 6 further comprising a burner coupled to the modular control box and protruding from the second opening of the second sealed chamber, the ignition means mounted to the burner and coupled to the control module, whereby the control module causes the ignition means to increase up to a predetermined temperature.

8. The heater assembly of claim 6 further comprising a means for closing the gas valve should the ignition means fail to ignite the gas.

9. The heater assembly of claim 5 wherein the ignition means comprises an element which heats up when electricity flows through it.

10. The heater assembly of claim 5 wherein the limited opening in the first sealed chamber is adapted to be able to receive an air inlet duct.

11. The heater assembly of claim 5 wherein the second end of the radiant tube is adapted to be able to receive an exhaust flue.

12. The heater assembly of claim 5 further comprising a baffles enclosed within the radiant tube to thereby increase heat transfer efficiency of the radiant tube.

13. The heater assembly of claim 5 further comprising a grill mounted to the housing to thereby direct heat as it escapes from the heater assembly.

14. A method of operating a gas radiant tube heater comprising the steps of:

providing a housing and a control box, removably coupled to the housing, forming a first sealed chamber coupled to a second sealed chamber, the second sealed chamber, in turn, being coupled to a radiant tube;

providing a limited air opening into the first sealed chamber from ambient surrounding air;

creating a vacuum pressure in the first sealed chamber and a positive pressure in the second sealed chamber whereby air flows from the first sealed chamber into the second sealed chamber;

providing an interruptable source of pressurized combustible gas into the second sealed chamber;

mixing the air in the second sealed chamber with the pressurized combustible gas in the second sealed chamber;

providing an air outlet from the second sealed chamber into the radiant tube; and burning the air and gas within the radiant tube.

15. The method of claim 14 further comprising the steps of:

sensing the flow of air into the first sealed chamber; and stopping the source of pressurized gas if the flow of air into the first sealed chamber ceases.

16. The method of claim 14 wherein the burning step is comprised of:

providing an ignition element; and heating the ignition element to a predetermined temperature to thereby ignite the gas and air mixture.

17. The method of claim 16 further comprised of stopping the source of pressurized gas into the second sealed chamber if the ignition element fails to continue igniting the air and gas.

* * * * *